US008390850B2

(12) United States Patent
Writt

(10) Patent No.: US 8,390,850 B2
(45) Date of Patent: Mar. 5, 2013

(54) TOY MAILBOX

(75) Inventor: John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 725 days.

(21) Appl. No.: 12/437,231

(22) Filed: May 7, 2009

(65) Prior Publication Data

US 2010/0284034 A1 Nov. 11, 2010

(51) Int. Cl.

| | |
|---|---|
| ***G06F 3/12*** | (2006.01) |
| ***B41J 29/13*** | (2006.01) |
| ***B41J 3/36*** | (2006.01) |
| ***A47G 29/12*** | (2006.01) |
| ***A63H 33/30*** | (2006.01) |

(52) U.S. Cl. ..... 358/1.15; 347/108; 347/109; 347/152; 347/170; 347/222; 347/263; 232/17; 232/19; 232/24; 232/25; 232/26; 232/30; 232/31; 446/475; 446/479; 463/1; 463/46; D21/398

(58) Field of Classification Search ..... 347/108, 347/109, 152, 170, 222, 263; 232/17, 19, 232/24–26, 30–31

See application file for complete search history.

(56) References Cited

U.S. PATENT DOCUMENTS

| | | | | |
|---|---|---|---|---|
| 4,847,633 | A * | 7/1989 | Piatt et al. | 346/134 |
| 5,026,042 | A * | 6/1991 | Miller | 271/119 |
| 5,308,058 | A * | 5/1994 | Mandel et al. | 271/289 |
| 5,387,043 | A * | 2/1995 | Fujioka et al. | 400/691 |
| 5,651,625 | A * | 7/1997 | Smith et al. | 400/691 |
| 6,379,058 | B1 * | 4/2002 | Petteruti et al. | 400/76 |
| 6,934,059 | B2 * | 8/2005 | Lundgren | 358/498 |
| 2001/0055121 | A1 * | 12/2001 | Omura et al. | 358/1.9 |
| 2003/0123079 | A1 * | 7/2003 | Yamaguchi et al. | 358/1.15 |
| 2004/0033099 | A1 * | 2/2004 | Van Bever | 400/615.2 |
| 2006/0018223 | A1 * | 1/2006 | Ji et al. | 369/47.12 |
| 2006/0061646 | A1 * | 3/2006 | Pierce | 347/108 |
| 2006/0228143 | A1 * | 10/2006 | Kuo | 400/88 |
| 2008/0150231 | A1 * | 6/2008 | Moody | 273/149 R |

* cited by examiner

*Primary Examiner* — King Poon
*Assistant Examiner* — Vincent Peren
(74) *Attorney, Agent, or Firm* — Justin M Tromp

(57) ABSTRACT

A toy mailbox for children includes a storage unit and a media processing mechanism. The storage unit includes a door member for closeably opening the storage unit and an ejection slot configured on a portion of the storage unit. The media processing mechanism is coupled to the storage unit, such that the media processing mechanism is capable of dispensing a media sheet having data content printed thereon, into the storage unit through the ejection slot. Opening the storage unit enables children to access the media sheet from within the storage unit. The media processing mechanism is also capable of printing the data content on the media sheet prior to dispensing the media sheet into the storage unit.

11 Claims, 3 Drawing Sheets

TOY MAILBOX

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to toys, and more specifically, to a toy mailbox capable of dispensing media sheets, such as postcards, having data content printed thereon.

2. Description of the Related Art

With the increased awareness about child psychology and development, toys have taken on a vital role in terms of enhancing reading and understanding abilities of children. Specifically, it has been observed that cognitive development of a child may be accomplished by various playing activities including playing with articles such as crossword puzzles, and toys for pretend play that include kitchen toys, puppets, and the like.

A suitable toy that may be used for assisting a child in pretend play for developing and enhancing reading and understanding capabilities of the child is a toy mailbox. In general, a postcard may be mailed to a child through the toy mailbox. Thereafter, the child may avail the postcard from within the toy mailbox. However, most of the toy mailboxes that are known in the art involve the use of postcards that simply include a particular type of text and/or images. Accordingly, the child may feel dismayed after a prolonged use of such toy mailbox, as receiving the same type of text and/or images on the postcards may bring monotony to the playing activity of the child.

Further, it has been observed that children fantasize about specific characters, such as a famous character of a movie, which may be admired by children. Accordingly, children may desire to engage themselves in pretend play involving a communication with such characters. Specifically, children may expect to have interactions with a particular character of their choice, while playing with various toys including a toy mailbox. Further, it has been observed that a simulated and fictitious communication with a particular character may aid in amusement of a child, in that it may address his or her expectations and preferences that vary from time to time. However, the toy mailboxes that are known in the art are incapable of providing such simulated interaction between a child and the characters admired by the child.

Accordingly, there is a need for a toy mailbox, which is capable of providing a simulated and fictitious communication between a child and a character admired by the child. Further, the toy mailbox should be capable of being used for amusement along with enhancing cognitive development of the child.

SUMMARY OF THE DISCLOSURE

In view of the foregoing disadvantages inherent in the prior art, the general purpose of the present disclosure is to provide a toy mailbox that is capable of providing a simulated and fictitious communication between children and characters admired by children, to include all the advantages of the prior art, and to overcome the drawbacks inherent therein.

In one aspect, the present disclosure provides a toy mailbox for children. The toy mailbox comprises a storage unit and a media processing mechanism. The storage unit comprises a door member for closeably opening the storage unit, and an ejection slot configured on a portion of the storage unit. The media processing mechanism is coupled to the storage unit, such that the media processing mechanism is capable of dispensing a media sheet having data content printed thereon into the storage unit through the ejection slot. Opening the storage unit enables children to access the media sheet from within the storage unit.

In another aspect the present disclosure provides a toy mailbox for children that comprises a storage unit and a printing device. The storage unit comprises a door member for closeably opening the storage unit and an ejection slot configured on a portion of the storage unit. The printing device is coupled to the storage unit, such that, the printing device is capable of printing data content on a media sheet and dispensing the media sheet into the storage unit through the ejection slot. Opening the storage unit enables children to access the media sheet from within the storage unit.

BRIEF DESCRIPTION OF THE DRAWINGS

The above-mentioned and other features and advantages of this disclosure, and the manner of attaining them will become more apparent and the disclosure will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. Unless limited otherwise, the terms "coupled," and variations thereof herein are used broadly and encompass direct and indirect couplings. Furthermore, the use of "coupled" and variations thereof herein does not denote a limitation to the arrangement of two components.

The present disclosure provides a toy mailbox for children. The toy mailbox is capable of providing a simulated and fictitious communication between a child and characters admired by the child, such as a famous character of a movie or a book. Accordingly, the toy mailbox of the present disclosure is capable of being used for amusement of the child along with enhancing cognitive development of the child.

The toy mailbox of the present disclosure includes a storage unit and a media processing mechanism coupled to the storage unit. The storage unit includes a door member for closeably opening the storage unit, and an ejection slot configured on a portion of the storage unit. The media processing mechanism is coupled to the storage unit, such that the media processing mechanism is capable of dispensing a media sheet having data content printed thereon, into the storage unit through the ejection slot. Further, opening the storage unit enables the child to access the media sheet from within the storage unit. The toy mailbox of the present disclosure is explained in detail in conjunction with FIGS. 1-3.

Figure 1:
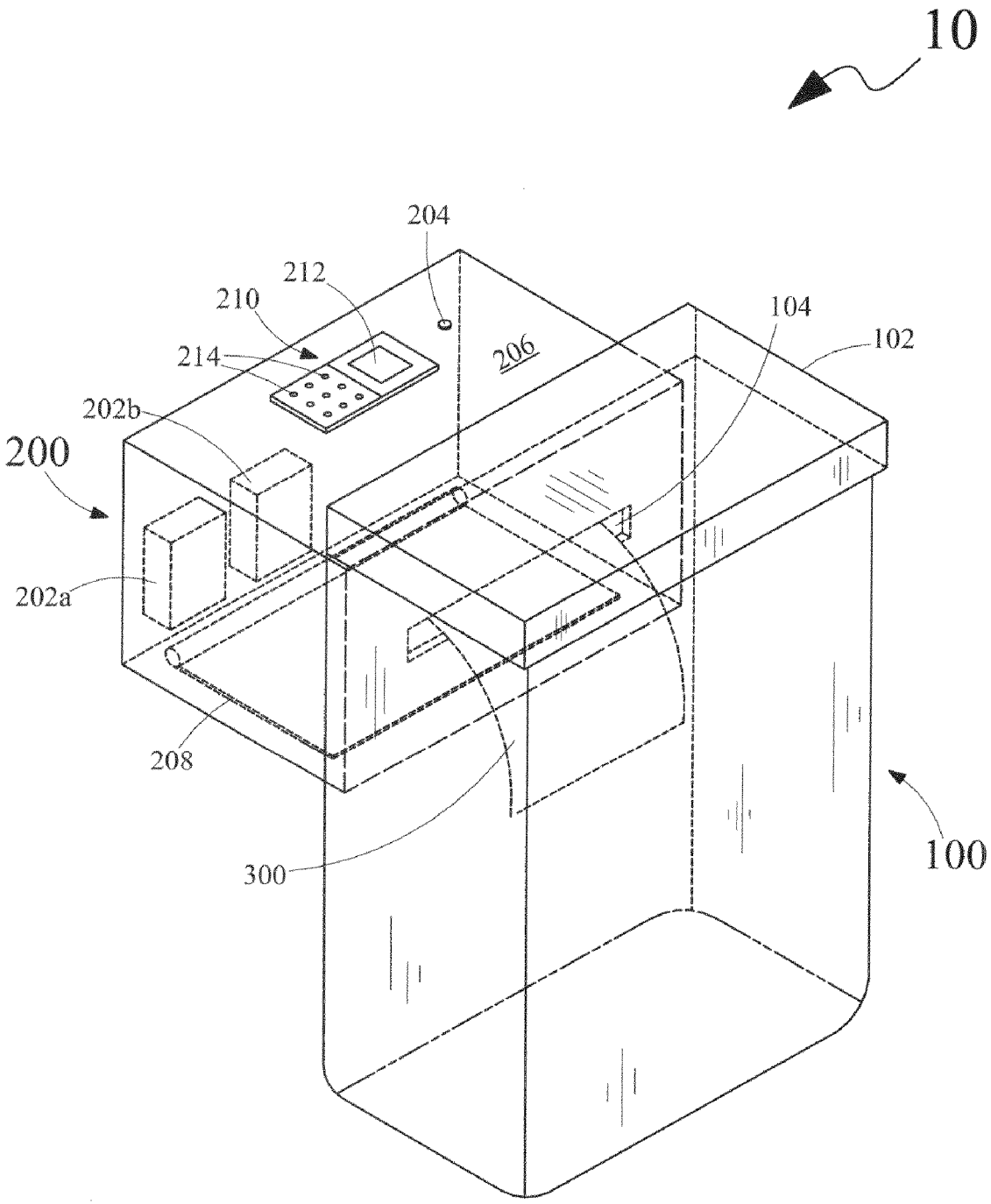
FIG. 1 is a perspective view depicting a toy mailbox according to an exemplary embodiment of the present disclosure.
Figure 2:
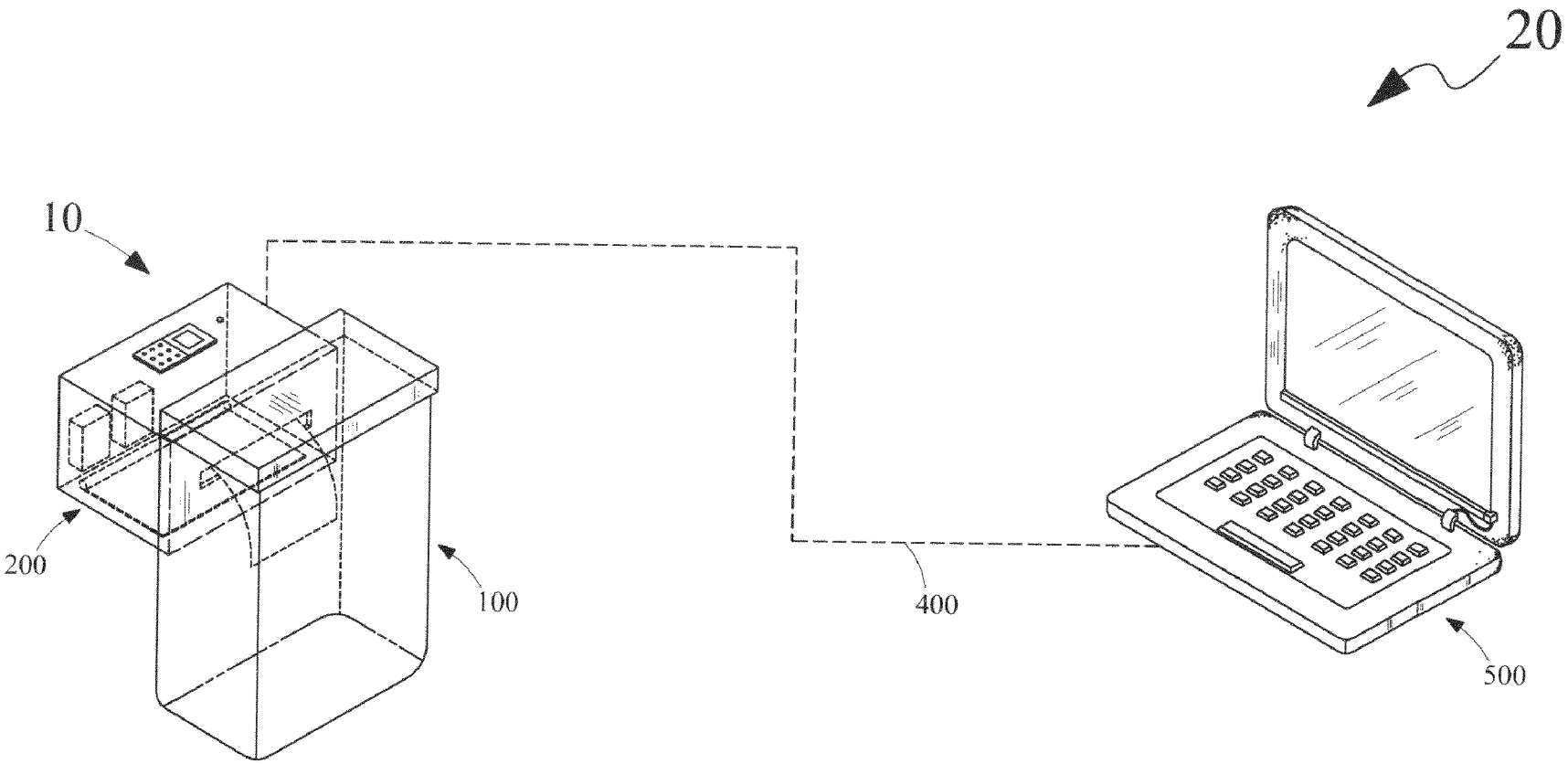
FIG. 2 depicts an environment in which the toy mailbox of FIG. 1 is configured with an electrical interface for receiving data content from a data content source, according to an exemplary embodiment of the present disclosure.

Reference will be made to FIGS. 1 and 2 to describe the toy mailbox, according to an exemplary embodiment of the present disclosure. FIG. 1 is a perspective view depicting the toy mailbox, and FIG. 2 depicts an environment in which the toy mailbox is configured for receiving data content from a data content source, according to an exemplary embodiment of the present disclosure.

Referring to FIG. 1, a perspective view of a toy mailbox 10 is depicted, according to an exemplary embodiment of the present disclosure. Toy mailbox 10 includes a storage unit 100 and a media processing mechanism 200 coupled to storage unit 100. Toy mailbox 10 may further include a supporting member (not shown) configured on a bottom portion (not shown) of media processing mechanism 200 for providing a support to toy mailbox 10 when placed on a flat surface, such as a surface of a table.

As shown in FIG. 1, media processing mechanism 200 is disposed on storage unit 100 and is coupled to storage unit 100. More specifically, media processing mechanism 200 is disposed on a portion (not shown) of a rear surface (not shown) of storage unit 100 and is coupled thereto by a suitable fastening mechanism, such as screws, nails, and the like.

Storage unit 100 of toy mailbox 10 includes a door member 102 for closeably opening storage unit 100. Specifically, in the present embodiment, storage unit 100 of toy mailbox 10 is a container having a cavity (not numbered) configured therewithin. Further, storage unit 100 is capable of being opened and closed by door member 102 for accessing the cavity of storage unit 100. Moreover, storage unit 100 is shown to have a hollow cuboidal shape. However, it will be evident to those skilled in the art that storage unit 100 may be configured to assume any other shape, such as a hollow cylindrical shape.

Storage unit 100 of toy mailbox 10 further includes an ejection slot 104 configured on a portion (not numbered) of the rear surface of storage unit 100. In the present embodiment, ejection slot 104 is a rectangular slit configured on within the portion of the rear surface of storage unit 100 that supports media processing mechanism 200 thereon. Specifically, media processing mechanism 200 is coupled to the rear surface of storage unit 100 in a manner such that media processing mechanism 200 is capable of dispensing a, media sheet 300 having data content (not shown) printed thereon, into storage unit 100 through ejection slot 104. Specifically, media sheet 300 dispensed from media processing mechanism 200, may be collected in the cavity of storage unit 100. Further, media sheet 300 may be accessed from within the cavity of storage unit 100 by a child by opening storage unit 100 with the help of door member 102. Suitable examples of media sheet 300 may include, but are not limited to, a postcard, a paper sheet, and an envelope. Suitable examples of the data content to be printed on media sheet 300 may include, but are not limited to, text matter and/or images, corresponding to one or more characters that the child may admire.

As explained herein above, media processing mechanism 200 is capable of dispensing media sheet 300 into storage unit 100. In one embodiment of the present disclosure, media processing mechanism 200 may be a media dispensing mechanism, which is capable of simply dispensing media sheets, including media sheet 300, stored within media processing mechanism 200. Accordingly, it will be evident to those skilled in the art that when media processing mechanism 200 is a mere media dispensing mechanism, pre-printed media sheets having the data content printed thereon, are dispensed by media processing mechanism 200. Specifically, in the present embodiment, media processing mechanism 200 may be an electro-mechanical arrangement capable of simply dispensing the pre-printed media sheets into the cavity of storage unit 100. Further, media processing mechanism 200 may include components such as, rollers, motors, gears, and connecting members, operatively coupled to each other for enabling the dispensing of the pre-printed media sheets into storage unit 100.

Further, the pre-printed media sheets may be dispensed by media processing mechanism 200 into storage unit 100 in a specific manner. For example, media processing mechanism 200 may be configured to dispense the pre-printed media sheets into storage unit 100 in one of a predetermined order, a random order, and a user-selected order. Specifically, media processing mechanism 200 may store the pre-printed media sheets, related to a specific character admired by the child, in a specific order. Accordingly, the pre-printed media sheets may then be dispensed in that specific order. As described above, such an order of dispensing the pre-printed media sheets may be one of the predetermined order, the random order, and the user-selected order.

For example, media processing mechanism 200 may be configured to select particular pre-printed media sheets having different portions of data content for a fictional character, such as 'Spider-Man™,' in a predetermined sequential order, and thereafter, to dispense the selected pre-printed media sheets into storage unit 100. Such different portions of data content may relate to experiences of 'Spider-Man™' during a journey, a thrilling battle, and the like. Alternatively, media processing mechanism 200 may be configured to randomly select a particular pre-printed media sheet, such as a pre-printed media sheet having a specific portion of the data content, from the pre-printed media sheets. An example of such pre-printed media sheet may be a pre-printed media sheet describing an experience of the fictional character 'Spider-Man™' during a thrilling battle, which is pre-printed as the specific portion of the data content. Media processing mechanism 200 may then dispense the randomly selected pre-printed media sheet into storage unit 100. Also, media processing mechanism 200 may be configured in a manner such that a user, such as a parent and a guardian of the child, is capable of selecting a sequential order in which the pre-printed media sheets having the different portions of the data content may be dispensed into storage unit 100.

Alternatively, when media processing mechanism 200 includes pre-printed media sheets including data content of a plurality of characters that are admired by the child, the pre-printed media sheets associated with the plurality of characters may be stored within media processing mechanism 200 in different groups based on the plurality of characters admired by the child. Specifically, each group of the different groups of the pre-printed media sheets may relate to a specific character from the plurality of characters. Further, media processing mechanism 200 may be configured to dispense the pre-printed media sheets of the plurality of characters into storage unit 100 in one of a predetermined order, a random order, and a user-selected order, in a similar manner as described above.

In an alternative embodiment, media processing mechanism 200 of the present disclosure may further be capable of printing the data content on media sheets, such as media sheet 300, prior to dispensing of the media sheets into storage unit 100. In such an embodiment, media processing mechanism 200 is configured as a printing device, which is capable of printing the data content on media sheet 300, and further capable of dispensing printed media sheet 300, into storage unit 100. Suitable examples of the printing device may include, but are not limited to, an electrophotographic printer, an inkjet printer, and a thermal printer.

The data content to be printed on media sheet 300 may be received from a data content source. Specifically, media processing mechanism 200 may be configured with an electrical interface for receiving the data content from the data content source prior to printing the data content on media sheet 300. The term "electrical interface" as used herein refers to an electrical connection (communication) configured between media processing mechanism 200 and the data content source. The term "data content received from a data content source" may refer to specific data content or a data content set that may be received from the data content source.

The electrical interface may be selected from the group consisting of a wired direct connection, a wired network connection, a wireless direct connection, and a wireless network connection. Moreover, the data content source may be selected from the group consisting of a local data storage device, a remote data storage device, a local data processing device, and a remote data processing device. Specifically, the local data storage device may be a memory device, such as a portable hard disk and a flash drive, capable of simply storing the data content therein, and capable of being coupled to media processing mechanism 200 with the help of the electrical interface. Further, the remote data storage device may also be a memory device capable of simply storing data content therein and is remotely placed with respect to media processing mechanism 200. Furthermore, the local data processing device may be a computer, such as a desktop and a laptop, capable of being coupled to media processing mechanism 200 with the help of the electrical interface. In addition, the remote data processing device may also be a server computer, which is capable of storing and processing data content therein, and is remotely placed with respect to media processing mechanism 200. Such a server computer may be coupled to media processing mechanism 200 with the help of the electrical interface.

In an instance, when the electrical interface is a wired direct connection, media processing mechanism 200 may be coupled to the data content source with the help of one or more wires for receiving the data content therethrough. In such an instance, it may be obvious to a person skilled in the art that media processing mechanism 200 may include an interface, such as a Universal Serial Bus (USB) interface (not shown), configured thereon for enabling the wired direct connection between media processing mechanism 200 and the data content source. Accordingly, the USB interface enables media processing mechanism 200 to receive the data content, to be printed on media sheet 300, from the data content source by the wired direct connection.

Further, when the electrical interface is a wired network connection, such as a Local Area Network (LAN) connection, media processing mechanism 200 may be coupled to the data content source with the help of the wired network connection configured through one or more wires for receiving the data content from the data content source. Further, the data content source may be selected from a plurality of data content sources of the wired network connection. It will be evident to those skilled in the art that a USB interface configured on media processing mechanism 200 may facilitate the wired connection between media processing mechanism 200 and the data content source through the wired network connection. Accordingly, the USB interface may facilitate receiving of the data content, to be printed on media sheet 300, by the wired network connection from the data content source.

Furthermore, when the electrical interface is a wireless direct connection, media processing mechanism 200 may be wirelessly coupled to the data content source, for receiving the data content therefrom. In such an instance, it will be evident to those skilled in the art that media processing mechanism 200 may include a port, such as an infrared port (not shown), configured thereon for enabling the wireless direct connection between media processing mechanism 200 and the data content source. Accordingly, the infrared port may facilitate receiving of the data content, to be printed on media sheet 300, wirelessly from the data content source.

Moreover, when the electrical interface is a wireless network connection, such as a wireless LAN (WLAN) connection, media processing mechanism 200 may be wirelessly coupled to the data content sources for receiving the data content from the data content source. Further, the data content source may be selected from a plurality of data content sources of the wireless network connection. In such an instance, it will be evident to those skilled in the art that media processing mechanism 200 may include a port, such as a wireless communication port (not shown), configured thereon for enabling the wireless network connection between media processing mechanism 200 and the data content source. Accordingly, the wireless communication port facilitates media processing mechanism 200 to wirelessly receive the data content, to be printed on media sheet 300, from the data content source.

The coupling of toy mailbox 10, and more specifically, media processing mechanism 200, with a specific data content source through a specific electrical interface, is explained in conjunction with FIG. 2, in accordance with an embodiment of the present disclosure.

FIG. 2 depicts an environment 20 in which media processing mechanism 200 of toy mailbox 10 is configured with an electrical interface 400 for receiving data content from a data content source 500, according to an embodiment of the present disclosure. Specifically, media processing mechanism 200 is coupled to data content source 500 by electrical interface 400 from receiving the data content therethrough. As shown in FIG. 2, data content source 500 is a laptop (data processing device). In the present embodiment, data content source 500 is shown to be a laptop. However, it will be evident to a person skilled in the art that data content source 500 may be any other type of data processing device.

Further, electrical interface 400 is a wireless direct connection, and accordingly, media processing mechanism 200 may be configured with an infrared port (not shown) for enabling the wireless direct connection between media processing mechanism 200 and data content source 500. The infrared port enables media processing mechanism 200 to receive the data content wirelessly from data content source 500 by electrical interface 400.

The data content received by media processing mechanism 200 from a data content source, such as data content source 500, may then be stored in a memory (not shown) of media processing mechanism 200.

In an embodiment of the present disclosure, the data content to be printed on media sheet 300 may be received from the internet either through a direct connection or through an indirect connection. For example, media processing mechanism 200 may be directly coupled to the internet with the help of a network connection, such as Ethernet network connection and/or IEEE 802.11 (wireless) network connection. Alternatively, media processing mechanism 200 may receive the data content from an internet enabled processing device, such as a computer, which may receive the data content from the internet. The received data content may be retrieved from the internet enabled processing device and transferred to media processing mechanism 200 by a USB interface configured thereon. The received data content may alternatively be retrieved from the internet enabled processing device and stored in a storage device, which may then be coupled to media processing mechanism 200.

Further, the data content to be printed on media sheet 300 may be a data content of an electronic mail that may be received by media processing mechanism 200 through the internet. More specifically, the data content to be printed on media sheet 300 by media processing mechanism 200 may be received from the server through a website. Additionally, a user-interface provided through the website may be used for composing the data content, prior to sending the data content to media processing mechanism 200 for being printed on media sheet 300.

Alternatively, media processing mechanism 200 may include one or more data cartridges having memory. The memory is capable of storing the data content that needs to be printed on media sheet 300. Specifically, as shown in FIG. 1, media processing mechanism 200 includes one or more data cartridges, such as data cartridges 202*a* and 202*b*. It should be understood that media processing mechanism 200 may include any number of data cartridges for storing data content therein.

The one or more data cartridges may include pre-stored data content corresponding to one or more characters admired by the child. In such an instance, the one or more data cartridges may act as the data content source that provides the data content to be printed on media sheet 300.

In the present embodiment, the one or more data cartridges are capable of storing a data content and/or a data content set related to either one or more characters admired by the child. For example, a data cartridge, such as data cartridge 202*a* of media processing mechanism 200 may store a data content corresponding to a specific character admired by the child. Further, media processing mechanism 200 may include a plurality of data cartridges, such as data cartridges 202*a* and 202*b*, where each data cartridge of the plurality of data cartridges may store a data content related to the one or more characters admired by the child. Specifically, the plurality of data cartridges may store a data content set related to a specific character admired by the child. Alternatively, the plurality of data cartridges may store a data content set related to the one or more characters admired by the child.

Media processing mechanism 200 of the present disclosure is configured in a manner such that the data content to be printed on media sheet 300 may be selected from the data content set pre-stored in the one or more data cartridges, in one of a predetermined order, a random order, and a user-selected order. For example, media processing mechanism 200 having a data cartridge, such as data cartridge 202*a*, may store data content related to the one or more characters in the data cartridge. Media processing mechanism 200 may be configured to select the data content from the data cartridge in one of the predetermined order, the random order, and the user-selected order. As another example, media processing mechanism 200 may include a plurality of data cartridges and each of the plurality of data cartridges may include a data content set. The data content to be printed on media sheet 300 may be selected from the data content set stored in the plurality of data cartridges in one of the predetermined order, the random order, and the user-selected order.

In the present embodiment, media processing mechanism 200 further includes an operable button 204 configured on an outer surface 206 of media processing mechanism 200. Operable button 204 may be used for initiating printing and dispensing of media sheet 300. More specifically, use of operable button 204 enables in controlling an operation of printing and dispensing of media sheet 300 based on the user's preference. For example, media sheets (not shown) supported on a feed tray 208 of media processing mechanism 200 may be printed with the data content, and further, dispensed into storage unit 100, when operable button 204 is pressed. It should be understood that feed tray 208 is configured within media processing mechanism 200 for holding the media sheets, such as media sheet 300, thereon. It should also be understood that media processing mechanism 200 is configured in a manner such that feed tray 208 is accessible to the user for providing additional media sheets for printing. It should be understood that feed tray 208 may be employed for holding preprinted media sheets, when media processing mechanism 200 is merely a media dispensing mechanism.

In the present embodiment, operable button 204 may be configured on media processing mechanism 200 in a hidden manner for restricting the access thereof to the user only. Specifically, operable button 204 may be configured at a portion of media processing mechanism 200 that is inaccessible to the child, and is accessible only to the user for enabling the user to initiate printing of the data content.

The data content to be printed on media sheet 300 may further be customized prior to the printing thereof. In one embodiment of the present disclosure, media processing mechanism 200 includes a user interface 210 configured on outer surface 206 of media processing mechanism 200 for the customization of the data content prior to the printing thereof. More specifically, user interface 210 enables the user to input information corresponding to the data content to be printed by media processing mechanism 200. The term "information" may include a file name, a memory location, a file path, and the like.

In the present embodiment, user interface 210 is an operating panel configured on outer surface 206 of media processing mechanism 200. User interface 210 includes a display screen 212. A suitable example of display screen 212 is a liquid crystalline display screen. Display screen 212 of user interface 210 serves as a menu screen depicting instructions thereon related to the operation of media processing mechanism 200. User interface 210 further includes a plurality of buttons 214 capable of being pressed for operating display screen 212. More specifically, by pressing plurality of buttons 214, display screen 212 may be operated for accessing the data content stored in the one or more data cartridges of media processing mechanism 200.

Further, plurality of buttons 214 of user interface 210 may be used for selecting type of the data content, such as text matter and images, for being printed on media sheet 300. For example, plurality of buttons 214 may enable selection of data content, such as the text matter (such as name of the child), to be printed on media sheet 300. However, it will be evident to those skilled in the art that by operating plurality of buttons 214 of user interface 210, a portion of the data content, such as an image stored in data cartridge 202*a*, may be also selected for being printed on media sheet 300. Accordingly, user interface 210 enables customization of the data content prior to the printing thereof. In an alternative embodiment, user interface 210 may include a touch-screen having multiple tabs configured thereon for customizing the data content prior to printing thereof.

Furthermore, user interface 210 enables the user to adjust a frequency for printing of media sheets, such as media sheet 300, with the customized data content and for dispensing the printed media sheets into storage unit 100. More specifically, the user may adjust a number of media sheets that may be printed and dispensed within a particular time period. Accordingly, user interface 210 is configured to provide options for setting the frequency for the printing and the dispensing of the media sheets. Specifically, user interface 210 may provide an option for "frequency" selection for setting frequency of the printing and the dispensing of the media sheets. Additionally, user interface 210 may provide an option for "randomess" selection for setting variability for the printing and the dispensing of the media sheets. For example, the media sheets would be printed and dispensed once in every 5 to 9 days, when the user sets an option of printing and dispensing to be 'once in a week' under "frequency" selection and '+/−2 days' under "randomness" selection. Additionally, user interface 210 may further be configured to provide an option of "print now" for allowing an instantaneous printing of the media sheets, as and when desired.

In another embodiment of the present disclosure, the data content source, which is coupled to media processing mechanism 200 may be used for the customization of the data content prior to printing thereof. As explained herein, media processing mechanism 200 is capable of being coupled to the data content source, such as data content source 500 (as shown in FIG. 2), for receiving data content therefrom. Accordingly, the customization of the data content to be printed on media sheet 300 by media processing mechanism 200 may be performed by the data content source coupled to media processing mechanism 200. In such an instance, the data content source may include requisite software, hardware or firmware for enabling communicable coupling between the data content source and media processing mechanism 200.

As explained herein above, when media processing mechanism 200 is the media dispensing mechanism, a media sheet, such as media sheet 300, may include pre-printed data content, for being simply dispensed into storage unit 100. However, when media processing mechanism 200 is the printing device, the media sheet may include a pre-printed portion of the data content thereon. More specifically, such a pre-printed portion of the data content may include one or more standard images and/or standard text matter, which are desired to be present on each media sheet that needs to be dispensed into storage unit 100.

For example, when the media sheet is a postcard, a first side of the postcard may include standard images. Accordingly, the first side of the postcard including the standard images may be pre-printed, whereas a second side opposite to the first side of the postcard may be utilized by media processing mechanism 200 for printing a remaining portion of the data content thereon. Such a remaining portion may be text matter that needs to be printed on the second side of the postcard. The utilization of the pre-printed media sheet averts a requirement of replacing an ink cartridge employed in media processing mechanism 200 for lifetime of toy mailbox 10. Accordingly, the ink cartridge of media processing mechanism 200 may be used for a longer time period without being refilled, thereby avoiding opening of media processing mechanism 200 for the replacement of the ink cartridge therefrom.

In an alternative embodiment, media processing mechanism 200 may be a duplex printer, which is capable of printing the data content on both sides of media sheet 300. Specifically, media processing mechanism 200 may be capable of printing images on the first side of media sheet 300 and text matter on the second side of media sheet 300.

Figure 3:
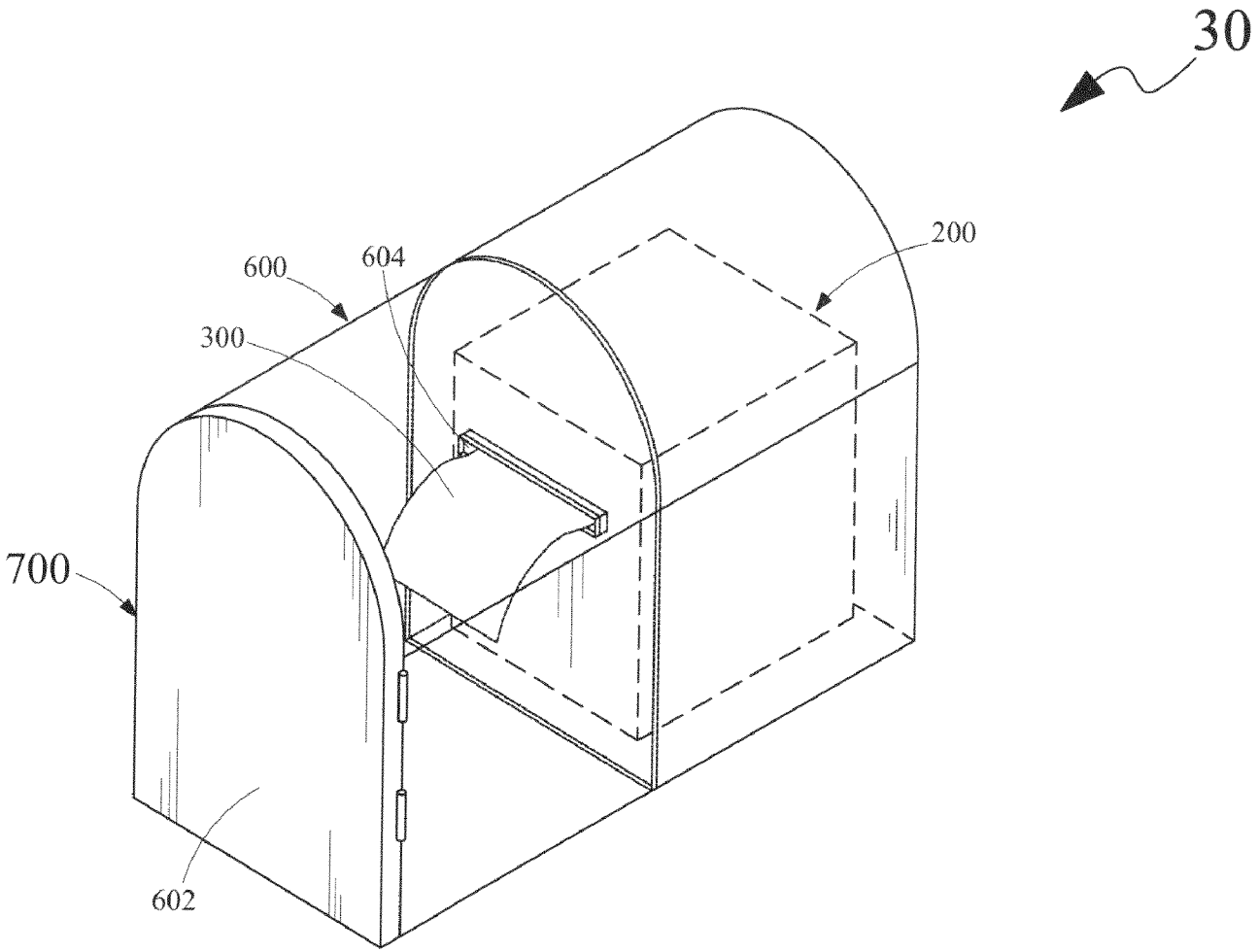
FIG. 3 is a perspective view depicting a toy mailbox, according to another exemplary embodiment of the present disclosure.

Referring now to FIG. 3, a perspective view of a toy mailbox 30 is depicted according to another exemplary embodiment of the present disclosure. Toy mailbox 30 includes a storage unit 600 and a media processing mechanism, such as media processing mechanism 200, coupled to storage unit 600. Specifically, toy mail box 30 includes a housing 700, which is compartmentalized into a first unit depicted as storage unit 600 and a second unit (not numbered) that includes media processing mechanism 200 therewithin. Accordingly, media processing mechanism 200 is disposed within the second unit of housing 700 in a manner, such that, media processing mechanism 200 is coupled to storage unit 600, as depicted in FIG. 3.

Storage unit 600 of toy mailbox 30 includes a door member 602 for closeably opening storage unit 600, and an ejection slot 604 configured on a portion of storage unit 600. In the present embodiment, ejection slot 604 is configured on a rear surface (not shown) of storage unit 600 that serves as an interface between storage unit 600 and media processing mechanism 200. Further, the rear surface of storage unit 600 supports media processing mechanism 200 thereon. More specifically, media processing mechanism 200 is coupled to the rear surface in a manner such that media processing mechanism 200 is capable of dispensing a media sheet, such as media sheet 300, having data content (not shown) printed thereon, into storage unit 600 through ejection slot 604. Furthermore, media sheet 300 may be accessed from within storage unit 600 by a child by opening storage unit 600 with the help of door member 602.

Media processing mechanism 200 of FIG. 3 is described in detail in conjunction with FIGS. 1 and 2. Accordingly, media processing mechanism 200 is not explained herein for the sake of brevity of description. Further, media processing mechanism 200 of FIG. 3 may be a media dispensing mechanism with or without a printing capability, as described in conjunction with FIGS. 1 and 2.

It should be understood that the toy mailbox, such as toy mailbox 10 and toy mailbox 30, of the present disclosure may be designed in a specific shape and size, as per a manufacturer's preference. Specifically, the toy mailbox may be designed in a manner that the toy mailbox is appealing to the eyes of a child. Accordingly, the toy mailbox may be manufactured in various colors. Further, the toy mailbox may be made of materials that are known in the art.

The present disclosure provides a toy mailbox, such as toy mailbox 10 and toy mailbox 30, for the amusement of children. The toy mailbox includes a media processing mechanism, such as media processing mechanism 200, capable of dispensing media sheets, such as postcards, having data content printed thereon. The toy mailbox further includes a storage unit, such as storage unit 100 and storage unit 600, capable of receiving the dispensed media sheets. The media sheets may then be accessed by a child from within the storage unit by opening the storage unit. Further, the data content printed on the media sheets is related to one or more characters admired by the child. The media sheets having the data content thereon serve as simulated pieces of mail received by the child. Accordingly, when the child avails the media sheets, a simulated and fictitious communication is set between the child and a specific character that child admires. Specifically, the child may remain under the impression that the media sheets containing a specific communication are sent by the specific character admired by the child. Furthermore, the data content printed on the media sheets may be customized from time-to-time as per the child's expectations, using the media processing mechanism of the toy mailbox. Accordingly, the toy mailbox of the present disclosure serves as an interactive tool that assists the child in playing. Further, the toy mailbox helps in enhancing cognitive development (reading and understanding capabilities) of the child.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A toy mailbox, comprising:

a housing having a first compartment and a second compartment separated from the first compartment by a barrier, said housing being shaped and decorated to simulate the appearance of a common postal mailbox;

a printing device enclosed within the first compartment of the housing and configured to print data content on a media sheet and to dispense the media sheet;

a slit through the barrier that permits the printing device to dispense the media sheet into the second compartment, the second compartment forming a storage area for holding the dispensed media sheet; and a closeable door positioned in a doorway on the housing, the door permitting access to the storage area through the doorway to retrieve the dispensed media sheet, the barrier blocking the view of the printing device through the doorway when the door is opened, wherein the printing device comprises a feed tray configured within the printing device for holding one or more media sheets.

2. The toy mailbox of claim 1 wherein the printing device is configured with an electrical interface for receiving the data content from a data content source prior to printing the data content on the media sheet.

3. The toy mailbox of claim 2 wherein the electrical interface is selected from the group consisting of a wired direct connection, a wired network connection, a wireless direct connection, and a wireless network connection.

4. The toy mailbox of claim 2 wherein the data content source is selected from the group consisting of a local data storage device, a local data processing device, a remote data storage device, and a remote data processing device.

5. The toy mailbox of claim 1 wherein the printing device comprises a user interface configured on a surface of the printing device.

6. The toy mailbox of claim 5 wherein the user interface enables a user to input information corresponding to the data content to be printed by the printing device.

7. The toy mailbox of claim 5 wherein the user interface enables a user to adjust a frequency for printing and dispensing the media sheet and enables a user to select a randomness option for setting variability of the printing and dispensing of the media sheet.

8. The toy mailbox of claim 1 further comprising an operable button configured on the printing device for initiating printing and dispensing of the media sheet into the second compartment.

9. The toy mailbox of claim 1 wherein the data content is a data content of an electronic mail.

10. The toy mailbox of claim 1 further comprising one or more data cartridges for storing data content therein.

11. The toy mailbox of claim 1 wherein the media sheet is a postcard.

* * * * *